United States Patent [19]

Rünzi

[11] Patent Number: 4,488,830

[45] Date of Patent: Dec. 18, 1984

[54] SHEET-BY-SHEET FEEDER WITH REFLEX PHOTO CELL LINE FEED CONTROL

[76] Inventor: Kurt Rünzi, Küsnachterstrasse 59, 8126 Zumikon, Switzerland

[21] Appl. No.: 472,148

[22] Filed: Mar. 4, 1983

[30] Foreign Application Priority Data

Mar. 8, 1982 [CH] Switzerland ..... 1400/82

[51] Int. Cl.[3] ..... B41J 13/02

[52] U.S. Cl. ..... 400/636; 271/110

[58] Field of Search ..... 400/636–637.1, 400/639, 629, 625, 624, 708.1, 708; 271/4, 110, 114, 116

[56] References Cited

U.S. PATENT DOCUMENTS

| | | | |
|---|---|---|---|
| 4,014,427 | 3/1977 | Rines | 400/708.1 |
| 4,101,018 | 7/1978 | Souolowsui | 400/708 |
| 4,257,712 | 3/1981 | McGuire | 400/708 |
| 4,268,021 | 5/1981 | Rutishauser et al. | 400/636.2 |
| 4,341,480 | 7/1982 | Mailer | 400/636 |
| 4,396,307 | 8/1983 | Shah et al. | 400/639.1 |

FOREIGN PATENT DOCUMENTS

| | | | |
|---|---|---|---|
| 133922 | 1/1979 | German Democratic Rep. | 400/636 |
| 2026392 | 2/1980 | United Kingdom | 400/636 |

OTHER PUBLICATIONS

"Document Insertion Device", IBM Technical Disclosure Bulletin, vol. 23, No. 8, Jan. 1981, pp. 3757–3758.
"Reflective Document Detector", IBM Technical Disclosure Bulletin, vol. 23, No. 1, June 1980, pp. 137–138.
"Transmissive Document Sensor", IBM Tech. Discl. Bulletin, vol. 22, No. 4, Sep. 1979, pp. 1585–1586.
"Sensing Sheet Movement", IBM Tech. Discl. Bulletin, vol. 23, No. 10, Mar. 1981, pp. 4800–4801.

*Primary Examiner*—E. H. Eickholt
*Attorney, Agent, or Firm*—Frishauf, Holtz, Goodman & Woodward

[57] ABSTRACT

A reflex photoelectric sensor (24) is provided to ascertain the precise position of a sheet of paper being fed around the writing roller 16 of an automatic typewriter or fast printer, to provide a signal from which the automatic drive of the writing roller can then advance the paper precisely so that what is written thereon will be in registry with pre-printed material on the paper, thus making it unnecessary to use edge-perforated long folded strips of paper in order to have precise location of lines automatically printed out on the paper.

2 Claims, 2 Drawing Figures

SHEET-BY-SHEET FEEDER WITH REFLEX PHOTO CELL LINE FEED CONTROL

This invention concerns the provision of sheet-by-sheet paper feed, such as is common in copying machines, to automatic writing machines which print character by character at a fast rate under automatic control.

The conventional way of feeding fast printers that print subject matter stored in a magnetic memory, for example, uses long, wide strips of paper folded in zigzag fashion with page succeeding page, the strip being provided with edge perforations, the automatic control of the printer operates with reference to the edge perforation, so that a precisely defined initial position is provided for the writing operation on each page. In the case of individual sheets of paper not connected to each other or sets of forms without edge perforation, such a control is not possible. Furthermore, in an automatic writing operation, care must be taken that with every newly inserted sheet it is possible to begin from a precisely defined position, so that registry between the printed matter already present on the page and the material to be written in may be obtained, for example in the case of letterhead stationery. There is a difficulty resulting from the fact that the successive entrainment of new pages by the writing roller can be accompanied with different degrees of slip, according to the thickness and stiffness of the writing roller, so that devices for sensing or monitoring paper position that are situated in advance of the writing roller in the paper transport direction provide no pointprecise reproducibility of the page position.

On the other hand, when the paper position detector is located past the writing roller in the transport direction there are likewise inaccuracies as the result of different degrees of arching of the sheet coming away from the writing roller. In addition, if the photoelectric control designed to respond to the paper edge coming out of the machine is spaced away from the writing roller, it is not possible to write with sufficient controllability in the top portion of the page near the top edge of the sheet. It is precisely this top page region that is important, for example, for placing the page numbering.

THE INVENTION

It is an object of the present invention to provide an individual page feed for printers (which are also called automatic writing machines, in order to distinguish them from printing presses) in which the position of the advancing edge of a sheet of paper can be precisely ascertained in the transport movement of the sheet produced by the writing roller, so that the sheet advance, starting from the sheet position thus ascertained, can then be performed precisely by the control system of the machine. The roller against which the daisy wheel or other printing element of the machine prints on the paper is here referred to as the writing roller.

Briefly, a sensor is provided very near a portion of the writing roller which, in the direction of paper transport, is past the location where the paper is inserted between a pressure roller and the writing roller and ahead of the location where the paper is released from pressure contact against the writing roller. The sensor is of the kind that responds to the brightness difference between the advancing edge of the sheet of paper being fed to the machine and the surface of the writing roller and provides a control signal for the drive of the writing roller. The sensor accordingly is mounted on a fixed part of the machine, preferably a guide that cooperates with the pressure roller system in leading the paper into engagement with the writing roller and then around the latter.

The invention makes possible the maintenance of paper position for printing which is reproducible with pin-point accuracy, which is particularly important in the case of pre-printed stationery, forms or the like. Furthermore, in the case of the invention it is easy to replace the writing roller — in any case along with the paper feeding system, without disconnecting and reconnecting any electrical lines, because the control system, including its sensor, remains connected in the interior of the machine casing by fixed wiring.

THE DRAWINGS

The invention is further described by way of illustrative example with reference to the annexed drawings, in which:

FIG. 1 shows an illustrative embodiment of a paper feed for an automatic writing machine according to the invention, in side view, mostly in section, except for the rollers, and FIG. 2 is a block diagram of a control system for the apparatus of FIG. 1.

DESCRIPTION OF THE ILLUSTRATED EMBODIMENTS

Figure 1:
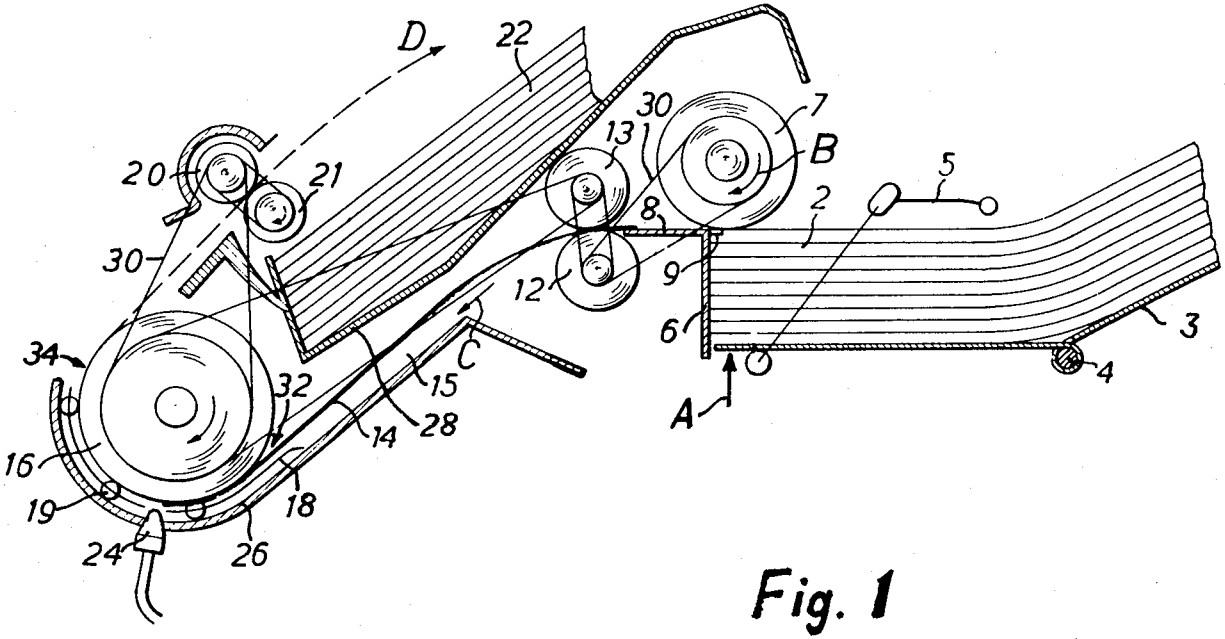

The page-by-page feed system of the present invention is intended to be built into a printer (automatic writing machine or an office machine similar thereto). The individual sheets of paper 14, which may be blank, preprinted stationery or printed forms, go into the machine from a supply stack 2, which is located on a rocking holder 3. The latter is pivoted on an axle 4 and is drawn upwards in the direction of the arrow A by a spring 5. The top sheet of the supply stack 2 lies in contact with and against an individual feed roller 7 (or an equivalent set of rollers). The bottom surface of the roller 7 is at approximately the same height as a table 8. The front edge of the supply stack 2 abuts against a stop wall 6 of sheet metal or plastic, here shown as integral with the table 8.

The individual sequential feed of the sheets of the stack is produced in a known way with the cooperation of two so-called corner separators 9, which are disposed at the front page corners adjoining the stop baffle 6 or table 8. The corner separators have a more or less triangular configuration and extend over the corners of the stack 2. When the individual feed roller 7 is driven in the direction of the arrow B, just the top sheet jumps out over these corner separators 9, thus preventing a double transport. The sheets thus singly fed out of the stack then get in between two driveable transport rollers 12 and 13 which transport the sheet 14 in the direction of the arrow C. The sheet 14 thus driven then gets into a channel 15 between a sheet metal or plastic guide 26 and the bottom surface of an output stack bin 28. Each sheet passing through the channel 15 is deflected downwards and led to the rear side of the writing roller 16. As it gets there, the sheet 14 is guided by a deflecting plate 18 and by pressure rollers 19 which cause the paper to proceed along the surface of the writing roller 16.

After proceeding past the printing mechanism, preferably a well known rapid print-writing mechanism, which is not shown in FIG. 1, in the feed-out region 34 at the front of the roller 16, each paper sheet 14 proceeds between the transport roller pair 20,21. The automatically typewritten (printed) individual sheets 14 are then deposited in the direction D onto an output stack 22. Between the paper insertion region 32 and the paper feed-out region 34 of the writing roller 16, which is to say somewhere along the lower half of that roller, there is located a photoelectric detector or sensor 24 which is affixed to a strucutral component fixed on the machine casing, in the illustrated case the stationery guide plate 26. The sensor 24 contains a photocell of the reflex type or a similar light sensitive device which responds to the luminosity difference between the dark writing roller, which is usually made of stiff rubber or the like, and a bright sheet of paper 14. The sensor 24 is connected with the control system of the automatic writing machine or similar business machine in question, which includes a controllable drive (not shown in FIG. 1) for the writing roller 16. Such drives are well known in printers that work on the output of word processors or computers and need not be further described here. The sensor signal produces a switching operation, for example, setting or resetting a line increment counter, as soon as the front edge of an introduced piece of paper reaches the field of the sensor 24. Then, proceeding from this now precisely defined position of the sheet of paper 14 being transported, the further advance of the paper can then be carried out by stepwise rotary movements of the writing roller 16. The control system and the drive of the roller 16 can then operate in the same manner as control drives operate with edge-perforated paper, which is to say that the control system can advance the paper so as to present a predetermined line position to the printing mechanism, and so one, by detecting the top of form.

In automatic control systems used for automatic typewriters, automatic printers and the like, memory components are provided which store the step count for the desired paper advance before writing begins and then at various places in the writing operation.

In the illustrated case, the sensor 24 is affixed to the arched paper guide plate 26 which is mounted in fixed position on the casing of the machine. The sensor could also be mounted on the pressure plate 18 or on a roller-holding frame carrying the rollers 19, which would likewise provide a stationary position for the sensor which is essentially fixed. Consequently, the writing roller 16 can be lifted out, in any case along with the entire paper feed system, without making it necessary to remove the sensor 24 or to disconnect any electrical connections.

The drive of the system is produced by a motor, not shown in FIG. 1, at one end of the writing roller 16. Endless cords or belts 30 are provided for transmitting the rotary movement of the roller 16 to the individual feed rollers 7 and the transport rollers 12, 13 and 20, 21. A single drive motor can provide both the stepwise feed of paper during printing and the relatively larger strokes of motion involved in feeding in a new page, but of course it is possible to provide separate motors for these two operations under a unitary control system. In either case, the movement of the writing roller 16 and that of the feed and transport rollers should be coordinated.

Figure 2:
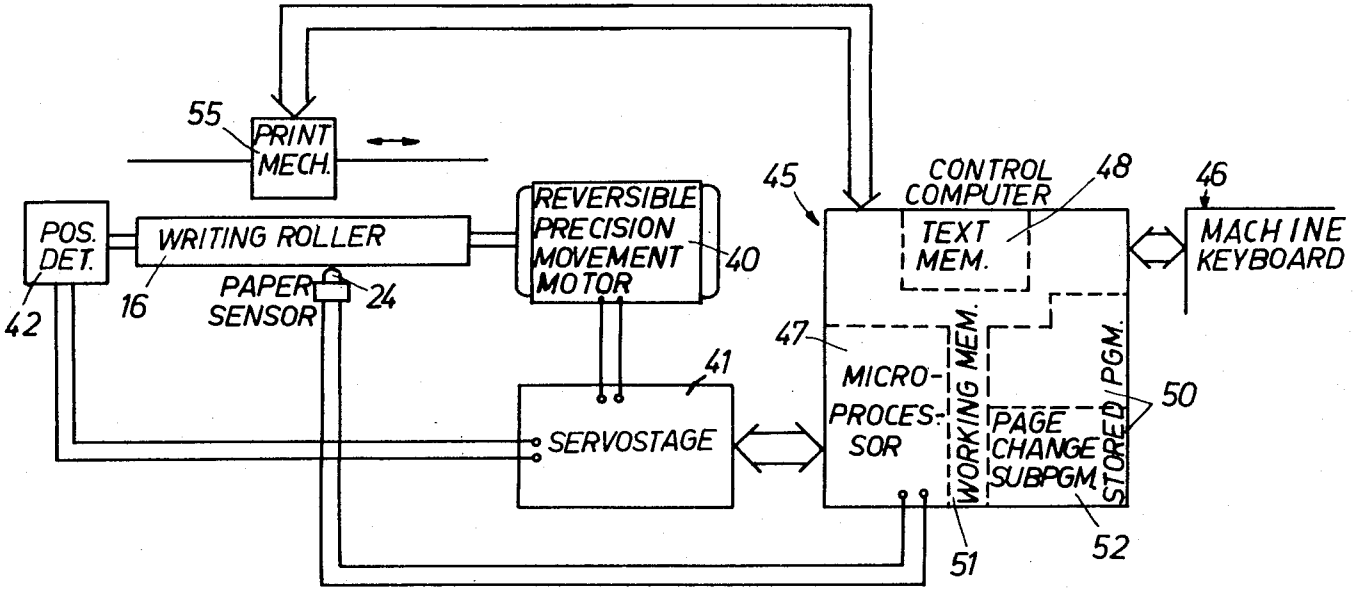

FIG. 2 is a basic block diagram illustrating the connection of the sensor 24 of FIG. 1 into a control system which is distinguished in this case by the provision of a page-change sub-program 52 which in itself does not need to be further described because the use of programming for such purposes is well known, the significant novelty being that the paper sensor 24 located as already described with reference to FIG. 1, makes it practical to provide a page-change sub-program in the control computer 45 that does not rely upon edge perforations in the paper for acurate registry of the paper.

FIG. 2 shows the writing roller 16 and the paper sensor 24 of FIG. 1, but does not otherwise show the apparatus of FIG. 1. The drive motor 40, which is capable of precision movement and is reversible, is shown, and the servo stage 41 which furnishes operating current for the motor 40 in precisely termed intervals to produce the desired movement, both for changing the paper in the machine from a completed sheet to a new sheet and for automatic writing onto the paper in accordance with the text memory' 48 of the computer 45. FIG. 2 also shows a position detector 42 for feeding the exact position of the writing roller back to the servo stage 41 and this making high precision of movement possible. If the writing machine in question has a mechanical line feed device so that the roller 16 only advances by increments of half a line, the position detector 42 is not necessary and all that is needed is a counter to count the advance increments. When the motor 40 drives not only the roller 16, but also the various paper feed rollers described in FIG. 1, a detector 42 which can rapidly and precisely measure the movement and position of the rotor electrically or optically is preferable. Although the detector 42 is shown connected to the servo stage 41, it could also be connected to the microprocess 47 of the control computer 45 either directly or through the servo stage 41.

The control computer 45, in addition to the microprocessor 47 and the text memory 48, also has a working memory 51 and a store program 50. It is connected to the machine keyboard 46 which is only partly indicatedin FIG. 2. It controls the printing mechanism 55 in the usual way for the particular kind of writing machine.

As mentioned before, instead of the paper feed rollers 7,12,13,20 and 21 being driven in tandem with the writing roller 16, they can be driven in accordance with the invention by a separate motor, or even two separate motors, it being necessary in that case that during the page change operation the rotation of the other rollers must be coordinated with the rotation of the writing roller 16 by the coordination of the movements commanded for the several motors.

Thus it will be seen that although the invention has been described with reference to a particular illustrative embodiment, variations and modifications are possible within the inventive concept.

I claim:

1. Sheet feeder for feeding separate sheets of paper to an automatic writing machine having a writing roller around which paper may be led for writing thereon by a print-writing mechanism, a pressure-roller guide for holding paper between it and said writing roller after paper has been inserted therebetween and means for controllably driving said writing paper so as to advance paper past said print-writing mechanism, said sheet feeder further comprising:

means, including a sheet-by-sheet feed roller (7) driven by the rotary movement of said writing roller (16), for feeding paper sheet by sheet from a paper sheet supply stack and inserting a sheet, thus fed, in between said writing roller and said pressure-roller guide in coordination with operation of said writing roller driving means;

means for feeding paper away from said writing roller to a paper receiving location in response to operation of said writing roller driving means;

means including a reflex photo cell (24) responsive to the difference between the greater reflectivity of the paper and the lower reflectivity of said writing roller and fixedly located near a portion of the lower half of the circumference of said writing roller (16) between the paper insertion region and the paper exit region of said pressure-roller guide for detecting at least the inserted edge of paper arriving between said writing roller and said pressure roller guide, for providing a "top of form" signal by which the beginning of advancement of a sheet of paper by said writing roller driving means may be timed, and to advance a sheet of paper, and accurately past said print-writing mechanism, for writing thereon; and control means (41,42,47), connected for activation by said "top of form" signal from said reflex photo cell, for advancing a sheet of paper accurately by stepwise operation of said writing roller driving means, and thereby bringing a desired line position on said sheet in position for beginning of writing.

2. Sheet feeder according to claim 1, in which said reflex photo cell is mounted on a fixed guide (26) which, together with said pressure-roller guide, functions to guide paper around said writing roller.

* * * * *